United States Patent [19]

Engdahl et al.

[11] Patent Number: 5,001,906

[45] Date of Patent: Mar. 26, 1991

[54] HIGH PRESSURE HEAT EXCHANGER FOR COOLING HIGH FOULING LIQUIDS

[75] Inventors: Gerald E. Engdahl, Wheaton; Per E. Duus, West Chicago, both of Ill.

[73] Assignee: Chicago Bridge & Iron Technical Services Company, Oak Brook, Ill.

[21] Appl. No.: 347,187

[22] Filed: May 4, 1989

[51] Int. Cl.[5] ..... F28D 15/00; F28D 7/08

[52] U.S. Cl. ..... 62/434; 165/145; 165/159

[58] Field of Search ..... 165/143, 145, 67, 159; 220/71; 62/434

[56] References Cited

U.S. PATENT DOCUMENTS

| | | | |
|---|---|---|---|
| 572,834 | 12/1896 | Smith | 165/143 |
| 1,899,191 | 2/1933 | Freeman | 165/143 X |
| 1,978,616 | 10/1934 | Baer | 165/159 X |
| 2,371,096 | 3/1945 | Zipeto | 165/159 X |
| 2,396,810 | 3/1946 | Atzberger | 165/159 X |
| 2,876,975 | 3/1959 | Short | 165/67 X |
| 3,623,631 | 11/1971 | Ford | 220/69 |
| 3,780,903 | 12/1973 | Clarkin et al. | 220/71 |
| 4,596,120 | 6/1986 | Knodel et al. | 62/59 |
| 4,750,333 | 6/1988 | Husain et al. | 62/118 |

FOREIGN PATENT DOCUMENTS

| | | | |
|---|---|---|---|
| 1121336 | 4/1982 | Canada | 165/159 |
| 623165 | 7/1961 | Italy | 165/145 |
| 169297 | 11/1959 | Sweden | 165/145 |
| 13089 | 10/1885 | United Kingdom | 165/159 |

OTHER PUBLICATIONS

*Heat Transfer*, J. P. Holman 4th ed. c. 1976 by McGraw Hill Inc. New York, pp. 386, 395, 396.

*Primary Examiner*—Allen J. Flanigan

*Attorney, Agent, or Firm*—Marshall, O'Toole, Gerstein, Murray & Bicknell

[57] ABSTRACT

A high pressure heat exchanger has a body with spaced apart parallel plates with side walls joined to the peripheral edge of each plate; a tubular high pressure liquid inlet header external of the body; a tubular high pressure liquid outlet header external of the body; a plurality of separate tubular runs in communication with the inlet and outlet headers; each tubular run including a tubular portion between substantially all adjacent plates of the body; the tubular portions of the same run being interconnected at one end by a tubular liquid return with a tubular portion on the opposite side of a first adjacent body plate and interconnected at the other end by a tubular liquid return with a tubular portion on the opposite side of a second adjacent body plate; the body internal plates having a liquid communication opening which permits a second liquid to flow from the space on one side of a baffle plate to the space on the other side of the baffle plate in a serpentine flow path through the body while in heat exchange contact with a first liquid flowing countercurrent in the tubular runs; the body having an inlet for feeding a second liquid into the body so that it flows countercurrent to the first liquid in the tubes; and the body having an outlet for withdrawing the second liquid from the body.

A method of making the heat exchanger is also disclosed as is refrigeration apparatus using the heat exchanger.

28 Claims, 5 Drawing Sheets

48
206
72
100
204
202
70
68
66
56
54
52
210
50
88
80
200
208
96
26
84
82
24
78
46
44
32
30
28

HIGH PRESSURE HEAT EXCHANGER FOR COOLING HIGH FOULING LIQUIDS

This invention relates to apparatus for and methods of heat exchange between fluids. More particularly, this invention is concerned with a novel high pressure heat exchanger which can be used as part of a total system for cooling high fouling liquids.

BACKGROUND OF THE INVENTION

A wide variety of liquids are used for heating and cooling purposes. However, the successful use of liquids for such purposes generally requires that the heating or cooling capacity of the liquid be withdrawn by means of a heat exchanger through which the liquid flows in indirect heat exchange with another liquid or a gas.

Many different types of heat exchangers are available but, in general, they are designed for use with relatively pure liquids so that fouling of the heat exchanger, regardless of whether it is the shell or tube side, or both sides, is minimal. Additionally, the heat exchangers are mostly useful for low pressure operation, i.e. below 200 psi, although there are some which are suitable for high pressure use but they are not designed for use with fouling liquids.

One of the uses of heat exchangers for cooling purposes is in deep mines where temperatures of 120° to 140° F. are not uncommon. An efficient way to cool deep mines is to produce an ice slurry at ground level and then feed it through a high pressure heat exchanger located deep in the mine. The resulting warm aqueous liquid is returned to ground level and again cooled to an ice slurry which is then recycled into the mine heat exchanger.

A mine cooling system as described requires a high pressure heat exchanger because the pressures involved are often above 3000 psi. Additionally, the system should be one which can handle an ice slurry without being easily plugged by ice deposits and should also be useful for cooling a wide range of waters available in a mine, many of which have a high mineral content which could foul the system. For example, several years ago mines tried closed loop high pressure shell and tube heat exchangers to directly cool the dirty mine water but they quickly fouled and had to be scrapped.

SUMMARY OF THE INVENTION

A high pressure heat exchanger, useful as part of a total heat exchange system, is provided including a body comprising a pair of spaced apart external parallel flat plates having substantially the same size and shape and with each plate terminating in a peripheral edge portion; the body having side wall means joined to the peripheral edge portion of each external plate thereby enclosing a heat exchange space defined by the external plates; a body having a plurality of spaced apart internal parallel flat baffle plates parallel to the external plates and joined to the body side wall means; a tubular high pressure liquid inlet header external of the body; means to feed high pressure liquid to the inlet header; a tubular high pressure liquid outlet header external of the body; means to withdraw high pressure liquid from the outlet header; a plurality of separate tubular runs in communication with the inlet and outlet headers; each tubular run including a tubular portion between substantially all adjacent plates of the body; the tubular portions of the same run being interconnected at one end by a tubular liquid return means with a tubular portion on the opposite side of a first adjacent body plate and interconnected at the other end by a tubular liquid return means with any tubular portion that is on the opposite side of a second adjacent body plate; the body interior having liquid communication means which permits a second liquid to flow from the space on one side of a baffle plate to the space on the other side of the baffle plate in a serpentine flow path through the body while in heat exchange contact with a first liquid flowing countercurrent in the tubular runs; the body having inlet means for feeding a second liquid into the body so that it flows countercurrent to the first liquid in the tubes; and the body having outlet means for withdrawing the second liquid from the body.

The high pressure heat exchanger is particularly useful in systems which use a cooling liquid, including an ice slurry, on the tube side thereof because the tubes can easily handle high pressures, such as are involved in mine cooling. The high pressure heat exchanger can be used as part of a cooling system capable of use with highly impure waters, such as are present in deep mines.

The tubular liquid returns at each end of the same tubular portion can be U-shaped tubular elements set in a vertical plane. Desirably, however, for most of the tubular runs, the tubular liquid return means at each end of the same tubular portion are U-shaped tubular elements set at essentially equal but opposite angles in a zig-zag pattern so that every other one of the tubular portions of a specific tubular run are on opposite sides of a plane normal to the body external plates.

The spaced apart parallel plates are rectangular and the tubular runs are substantially parallel to the longer side edges of the rectangular plates.

The high pressure liquid outlet header can be substantially adjacent to the short side edge of the rectangular plates at one end of the heat exchanger. The high pressure liquid inlet header can also be substantially adjacent to the short side edges of the rectangular plates at one end of the heat exchanger. Also, the high pressure liquid outlet and inlet headers can be on the same end or opposite ends of the heat exchanger.

Each of the internal spaced apart parallel baffle plates can have a slot adjacent one end and the tubular liquid return means can be located in the slots, with the slots being at alternating ends of adjacent baffle plates.

The side wall means can comprise spacer bars between the edges of adjacent plates and the plate edges can be welded to the spacer bars and the adjoining spacer bar edges can be welded together.

The external diameter of the tubular portions between the plates can be less than the distance between adjacent parallel plates. Also, cross bars can be positioned lateral to the tubular portions between and in contact with the tubular portions and an adjacent parallel plate.

At least one side of each internal plate can be covered with a layer of thermal insulation.

The external parallel plates are desirably reinforced externally by stiffener means.

In a more specific embodiment, the invention provides a high pressure heat exchanger including a body comprising a plurality of spaced apart parallel plates all having substantially the same size and shape and with each plate terminating in a peripheral edge portion; the body having side walls means joined to the peripheral edge portion of each plate thereby enclosing a space defined by the plurality of plates; a tubular high pressure liquid inlet header external of the body; means to feed high pressure liquid to the inlet header; a tubular high pressure liquid outlet header external of the body; means to withdraw high pressure liquid from the outlet header; a plurality of separate tubular runs in communication with the inlet and outlet headers; each tubular run including a tubular portion between substantially all adjacent plates of the body; the tubular portions of the same run being interconnected at one end by a tubular liquid return means with a tubular portion on the opposite side of a first adjacent body plate and interconnected at the other end by a tubular liquid return means with any tubular portion that is on the opposite side of a second adjacent body plate; the body internal plates having liquid communication means which permits a second liquid to flow from the space on one side of a baffle plate to the space on the other side of the baffle plate in a serpentine flow path through the body while in heat exchange contact with a first liquid flowing countercurrent in the tubular runs; the body having inlet means for feeding a second liquid into the body so that it flows countercurrent to the first liquid in the tubes; and the body having outlet means for withdrawing the second liquid from the body.

The invention also provides refrigeration apparatus comprising a closed loop including cooling means to cool an aqueous liquid, conduit means for feeding the cooled aqueous liquid from the cooling means to and through the tube side of a high pressure heat exchanger as defined above, means for withdrawing warmed cooling liquid from the tubular side of the heat exchanger and returning it to the cooling means to be cooled again; and conduit means for feeding a warm fluid to and through the plate side of the heat exchanger to produce cooled fluid, conduit means for withdrawing the cooled fluid from the heat exchanger and delivering it to a destination to be used for refrigeration purposes whereby it is converted to warm fluid, and conduit means for returning the warm fluid to the plate side of the heat exchanger.

The cooling means can be at the earth surface of an underground mine and the heat exchanger at a mine horizon.

The cooling means can be one which converts at least a portion of the aqueous liquid to ice to produce an ice slurry.

The aqueous liquid can be water, a salt brine, an aqueous glycol solution or any other suitable liquid.

The apparatus can be arranged, for optimum efficiency, for flow of the warm fluid in the heat exchanger countercurrent to the flow of the cooling fluid in the tubular runs in the heat exchanger.

The invention also provides a method of assembling a heat exchanger comprising assembling a plurality of separate but side-by-side tubular runs, with each tubular run including spaced apart tubular portions, the tubular portions of the same run being interconnected at one end by a tubular liquid return means with an adjacent end of a tubular portion on an opposite side thereof to place the tubular portions in liquid communication with each other; connecting inlet ends of the separate tubular runs to a high pressure inlet header, and outlet ends of the separate tubular runs to a high pressure outlet header to thereby form a tube-side assembly; preparing a plurality of flat plates having substantially the same size and shape and with each plate terminating in a peripheral edge portion, the plurality of flat plates including first and second external plates and a plurality of baffle plates; making suitable shell side inlet openings in the first external plate and attaching a shell side low pressure inlet header to the outer surface of the first external plate; making suitable shell side outlet openings in the second external plate and attaching a shell side low pressure outlet header to the outer surface of the second external plate; placing the tube-side assembly in position with respect to one of the first and second external plates so that the tubular runs are essentially normal to the interior surface of the plate; cutting a lateral slot in each baffle plate adjacent one end with the slots being at alternating ends of every other baffle plate and with the slots being sized to receive the liquid return means of each tubular run; sliding a baffle plate between each pair of tubular portions such that a slot receives a liquid return means of each tubular run; and applying side wall means joined to the peripheral edge portion of each external plate thereby enclosing a heat exchange space.

The side wall means can be produced by inserting spacer bars between the edges of adjacent plates and welding the plate edges together and to the spacer bars. The method can also include positioning at least two cross bars between the same side of each baffle plate and the adjacent tubular portion of each tubular run and securing the cross bars in place.

In performing the method, for most of the tubular runs, the tubular liquid return means at each end of the same tubular portion can be U-shaped elements set in essentially a vertical plane. The U-shaped tubular elements can be set at essentially equal but opposite angles in a zig-zag pattern so that every other one of the tubular portions of a specific tubular run are on opposite sides of a plane normal to the external plates.

The method can include making all the plates rectangular and positioning the tubular runs to be substantially parallel to the longer side edges of the rectangular plates. Also, the method can include positioning the high pressure liquid outlet header substantially adjacent to the short side edges of the rectangular plates at one end of the heat exchanger and/or positioning the high pressure liquid inlet header substantially adjacent to the short side edges of the rectangular plates at one end of the heat exchanger. Furthermore, the method can include positioning the high pressure liquid outlet and inlet headers on the same or opposite ends of the heat exchanger.

When desired or appropriate the method can include insulating at least one side of each baffle plate and/or applying stiffening means to the outside surface of the first and second external plates.

DETAILED DESCRIPTION OF THE DRAWINGS

To the extent it is reasonable and practical the same or similar elements which appear in the various views of the drawings will be identified by the same numbers.

Figure 1:
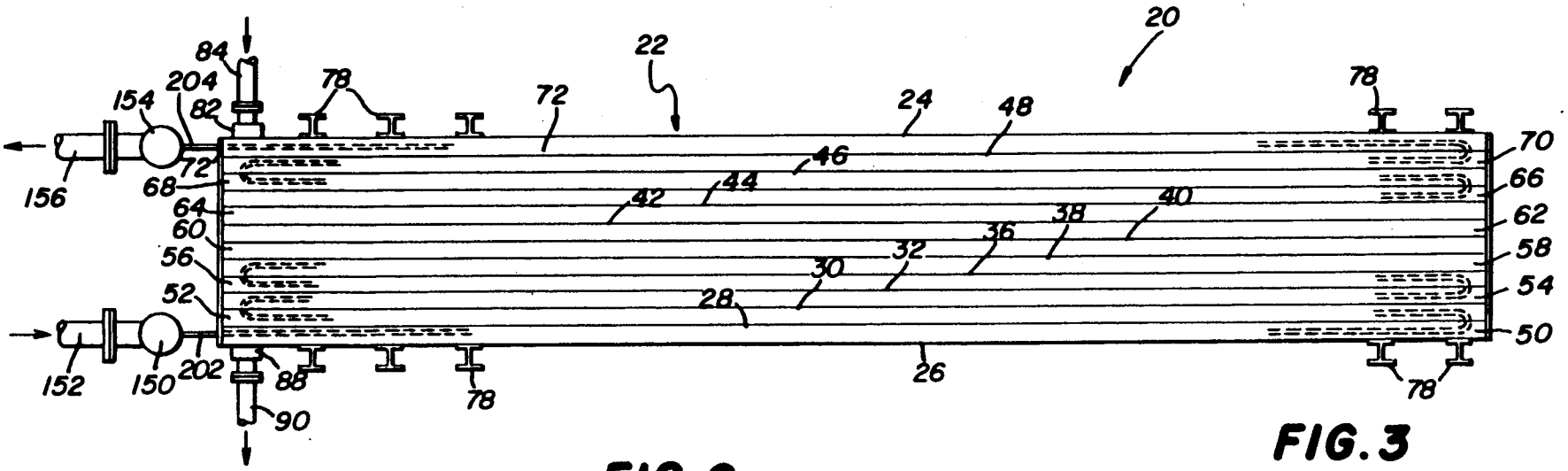
FIG. 1 is a side elevation of one embodiment of high pressure heat exchanger provided by the invention.
Figure 3:
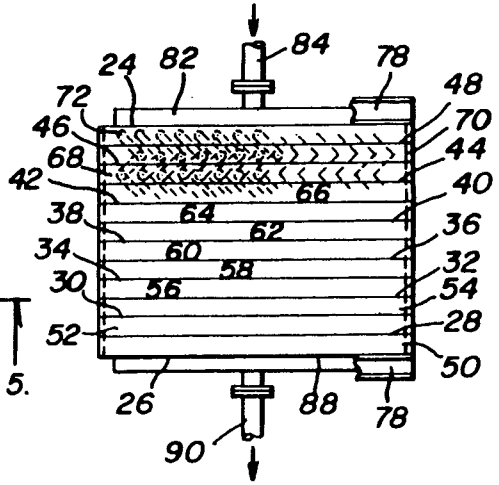
FIG. 3 is an end view of the heat exchanger shown in FIGS. 1 and 2.
Figure 2:
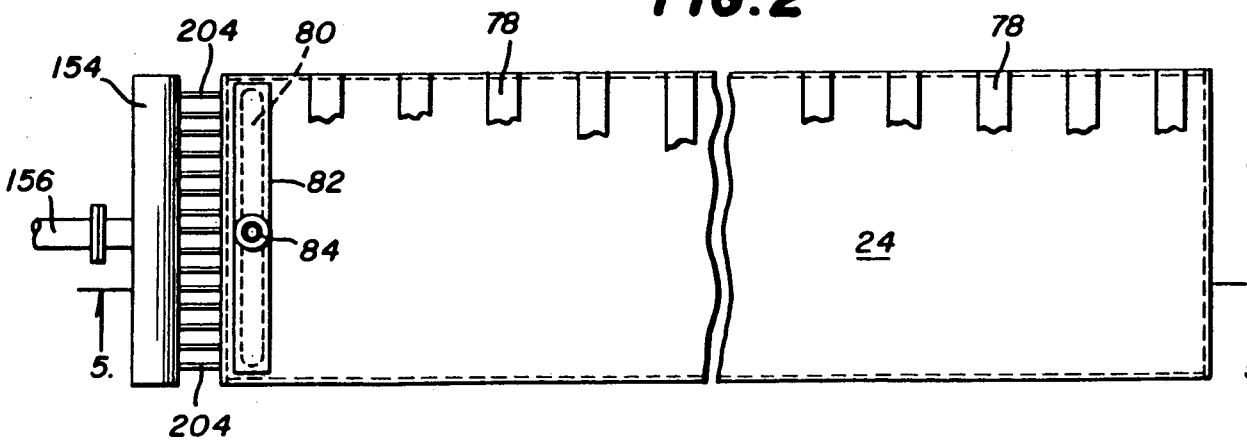
FIG. 2 is a plan view of the heat exchanger shown in FIG. 1.

With reference to the drawings, and particularly FIGS. 1 to 3, the high pressure heat exchanger 20 has a body 22 which includes a pair of spaced apart external parallel flat plates 24,26 having the same size and rectangular shape and with each plate terminating in a peripheral edge portion. The body also includes a plurality of spaced apart internal parallel flat baffle plates 28,30,32,34,36,38,40,42,44,46,48 which are parallel to the external plates 24,26. The baffle plates are essentially the same size and shape as the external plates.

Spacer bars 50,52,54,56,58,60,62,64,66,68,70,72 are positioned between the edges of the respective adjacent external plates 24,26 and the respective baffle plates 28–48 and the plate edges are welded to the spacer bars and the adjoining spacer bar edges are welded together. The spacer bars generally have the same height and thickness. In this way the four side walls of the body 22 are formed.

The heat exchanger body 22 is reinforced by welding I-beam stiffeners 78 to the outside of top external plate 24 and to the outside of the bottom external plate 26. The stiffeners 78 are positioned lateral to the length of the heat exchanger and are spaced apart a suitable distance from the adjacent stiffeners.

An elongated slot 80 is cut into one end portion of top external plate 24 and inlet header 82 is positioned over the slot and is welded to the top external plate. Fluid inlet pipe 84 is connected to inlet header 82 in fluid communication therewith.

An elongated slot 86 is cut into one end portion of bottom external plate 26 and outlet header 88 is positioned over the slot and is welded to the bottom external plate 26. Fluid outlet pipe 90 is connected to outlet header 88 in fluid communication therewith.

A layer of insulation material 96, which is optional for some uses of the heat exchanger, is positioned to the underside surface of the top external plate 24 and to each of the baffle plates 28–48. Additionally, it may be desirable to similarly insulate the upper side surface of bottom external plate 26.

Each baffle plate 28–48 has a lateral slot 100 near one end. The slot 100 is located at opposite ends of adjacent baffle plates. Thus, baffle plate 28 has a slot 100 at the right end, baffle plate 30 has a slot 100 at the left end, baffle plate 32 has a slot 100 at the right end and so on. Each slot 100 extends from the edge of a baffle plate and extends nearly across the width of the plate so that the slot is closed at one end and open at the other end before the plate is assembled into the heat exchanger body. The open end of the slot is located between a pair of spacer bars 50–72 and is closed during welding. The slots 100 provide for countercurrent flow of fluid on the shell side of the heat exchanger. Additionally, they provide openings through which the U-shaped tubular 180° liquid return means can extend.

A tubular high pressure liquid inlet header 150 is positioned laterally of the body 22 along the lower end portion thereof. The high pressure header 150 is provided with a connecting pipe 152 which delivers the feed liquid to the header. Also, a tubular high pressure liquid outlet header 154 is positioned laterally of the body 22 along the upper end portion thereof. The high pressure outlet header 154 is provided with a connecting pipe 156 which receives the liquid outlet stream from the header. Although the headers 150,154 are shown in the drawings located adjacent the same end of body 22 they can be positioned at opposite ends of the body.

A plurality of separate identical tubular runs or coils 200 (FIG. 6) are positioned vertically in body 20 in a side-by-side but spaced apart arrangement. Each tubular run 200 has an inlet end 202 connected to high pressure inlet header 150 and an outlet end 204 connected to high pressure outlet header 154. Each tubular run 202 includes a straight tubular portion 206 between each pair of adjacent plates 24, 28–48, 26. Each tubular portion of the same run is interconnected at one end by a tubular liquid return U-shaped 180° connector 208 with a tubular portion on the opposite side of a first adjacent baffle plate and interconnected at the other end by a tubular liquid return U-shaped 180° connector 208 with a tubular portion 206. The connectors 208 are located in slots 100 at the opposite ends of adjacent baffle plates 28–48. As a result the tubular runs 200 are serpentine in arrangement so that the liquid flow changes direction as it passes from one to the next adjacent tubular portion 206 (FIG. 5).

Figure 4:
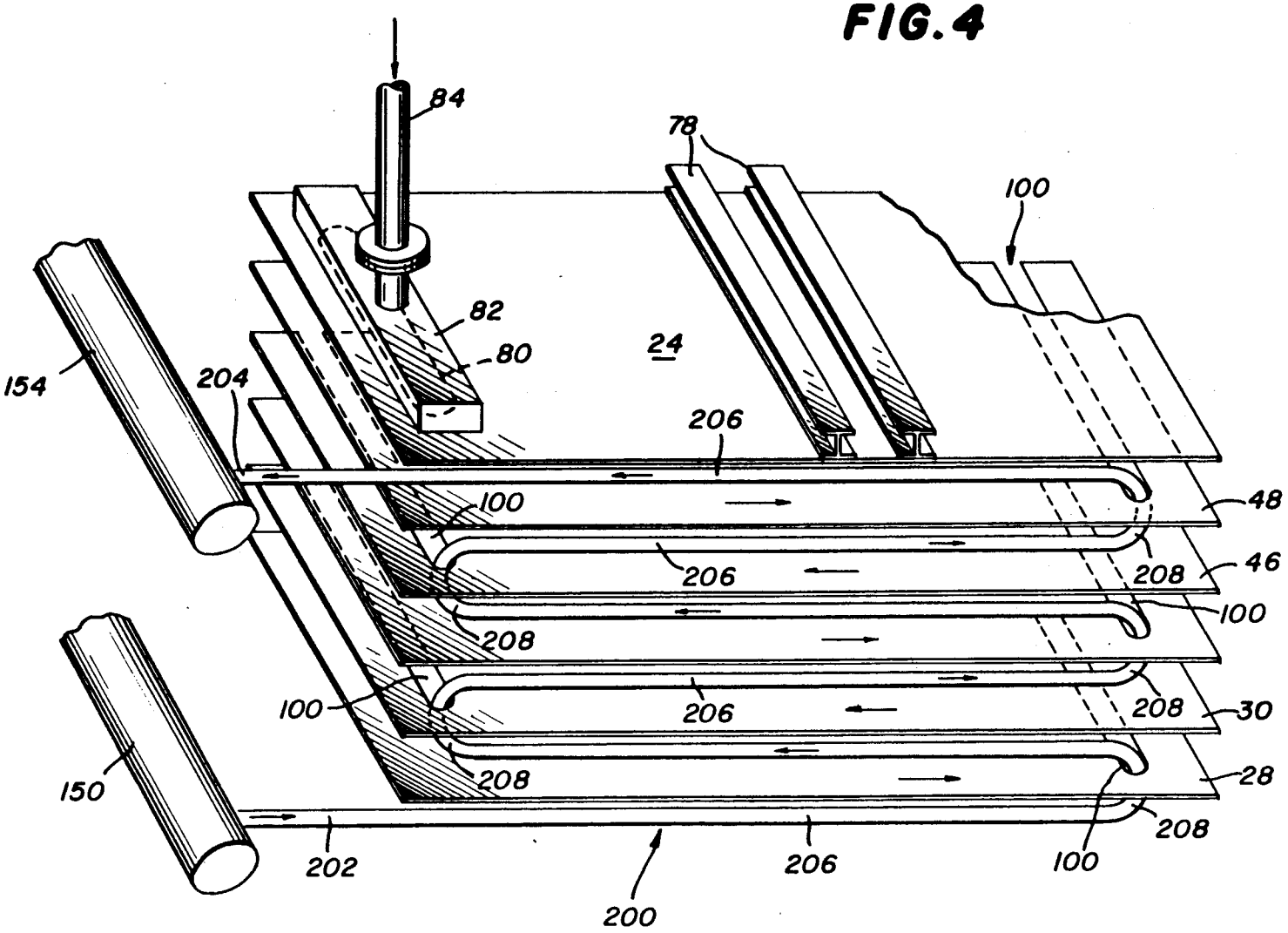
FIG. 4 is an exploded conceptual view of a heat exchanger of the invention which is presented to aid in better visualizing the structure illustrated by the other drawings.
Figure 5:
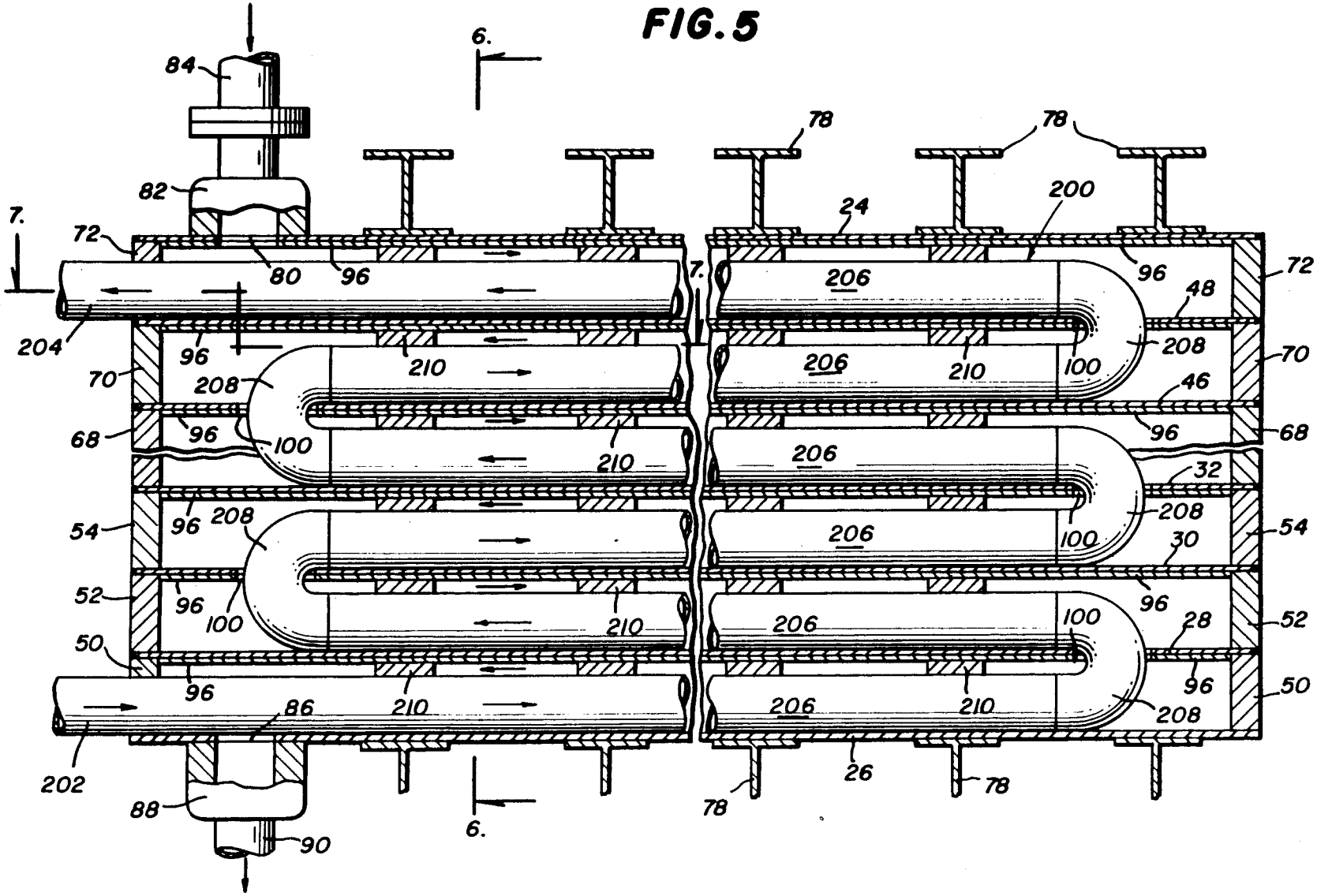
FIG. 5 is a sectional view taken along the line 5—5 of FIG. 2.
Figures 6, 7:
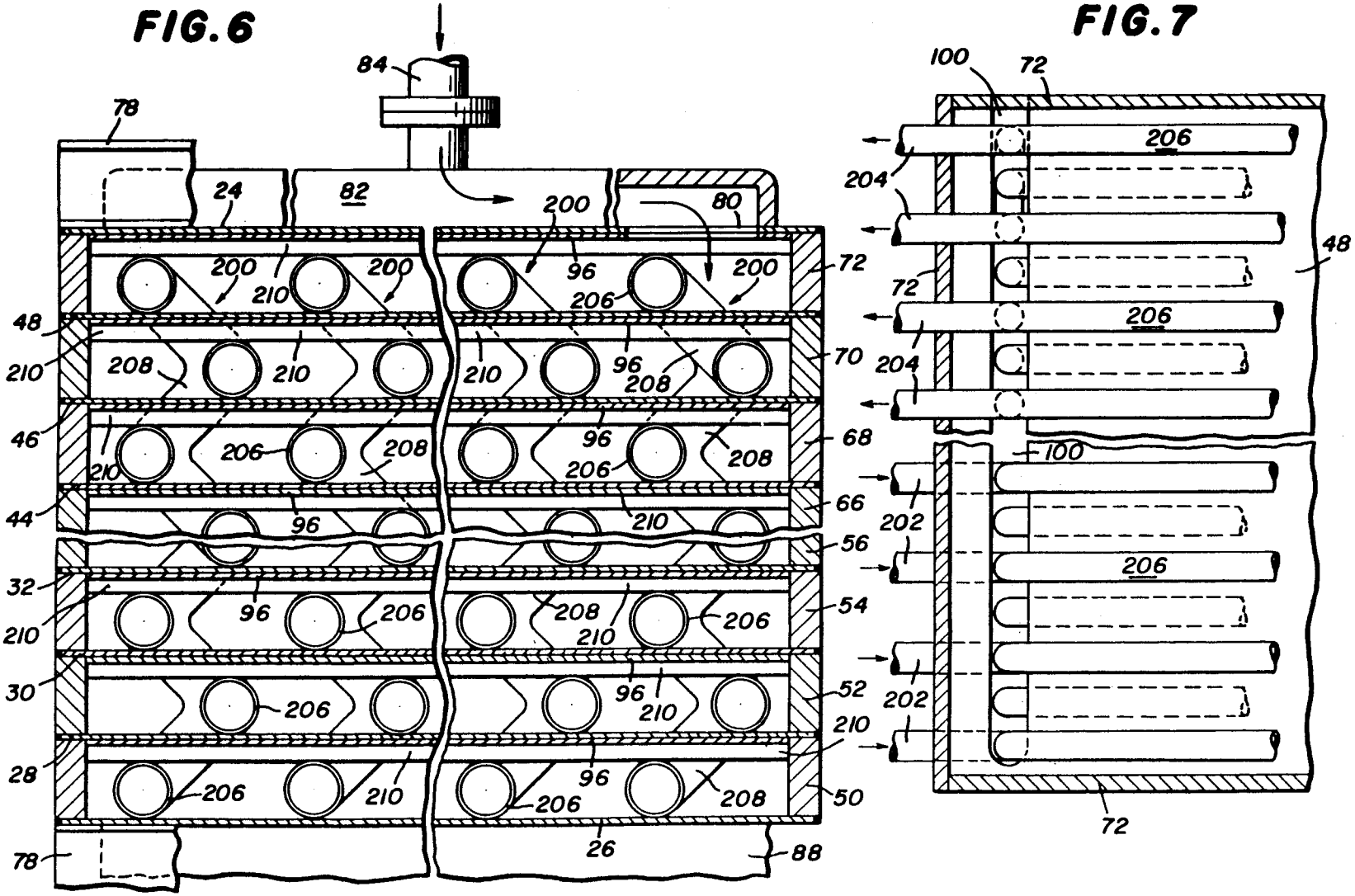
FIG. 6 is a sectional view taken along the line 6—6 of FIG. 5.
FIG. 7 is a sectional view taken along the line 7—7 of FIG. 5.

In the embodiment shown in FIG. 5, the U-shaped 180° connectors 208 in each tubular run are set at essentially equal but opposite angles in a zig-zag pattern so that every other one of the tubular portions 206 of a specific tubular run 200 are on opposite sides of a plane normal to the body external plates 24,26. The conceptual drawing of FIG. 4, however, illustrates how the tubular portions 206 and U-shaped 180° connectors 208 can be set in essentially a vertical plane. It is preferred to have the connectors 208 in a zig-zag pattern as shown in FIG. 6 because that permits positioning the baffle plates and external plates closer together than when vertical as in FIG. 4. Even so, the vertical height between adjacent plates 26,28–48,24 is usually greater than the outside diameter of tubular portions 206 so as to avoid having the U-shaped connectors 208 set at an angle less than about 45° because if they were positioned closer to horizontal there would be inadequate space for liquid on the shell side to flow alongside the tubular portions 206. To accommodate the extra height between adjacent plates when the connectors are at 45°, lateral spaced apart spacer bars 210 are positioned on the top of the tubular runs and welded thereto (FIG. 5).

The described apparatus can be assembled by assembling a plurality of separate but side-by-side tubular runs 200 with the inlet ends 202 connected to the high pressure inlet header 152 and the outlet ends 204 connected to the high pressure outlet header 154. All of the baffle plates 28–48 and the top and bottom external plates 24,26 are cut to size and slots 100 cut in the baffle plates. The spacer bars 50–72 are cut to size as well as the cross bars 210. Spacer bar 50 at the short end of the body 22 adjacent high pressure inlet header 150 can be provided with holes and fit over the ends 202 before the header 150 is installed. Similarly, spacer bar 72 at the short end of the body 22 adjacent high pressure outlet header 154 can be provided with holes and fit over the ends 204 before the header 154 is installed. Alternatively, after the holes are drilled the bar can be cut horizontally in half and the two halves put in place on top and bottom of the tubes respectively.

After the tubular runs 200 are fabricated and connected to the headers 150,154, the tubular runs 200 are placed on bottom external plate 26 which has already had header 88 positioned over slot 86. Then baffle plate 28 is slid in place with the slot 100 therein freely receiving the connectors 208. Then the cross bars 210 are welded to the outer tubular portions 206. The spacer bars 50 are then put in place on the bottom external plate 26. The spacer bars 50 are then welded all around to bottom external plate 26 and baffle plate 28. Then the next baffle plate 30 is fit in place above the next tubular portions 206 with the slot 100 in the plate on the opposite end from the slot 100 in plate 28. The spacer bars 52 are then put in position and welded to the edges of the upper and lower baffle plates. This is repeated until all the baffle plates and spacer bars are installed and welded into place. The top spacer bar 72 can be drilled, cut in half and the two halves positioned so that the outlet ends 204 are located in the split holes as described above regarding spacer bar 50.

Before the top external plate 24 is put in position in fabricating the heat exchanger, slot 80 is cut in the plate and inlet header 82 is welded to the plate over the slot.

The reinforcing stiffeners 78 can be installed on the top and bottom external plates 24,26 before or after those plates are positioned in the assembly.

Figure 8:
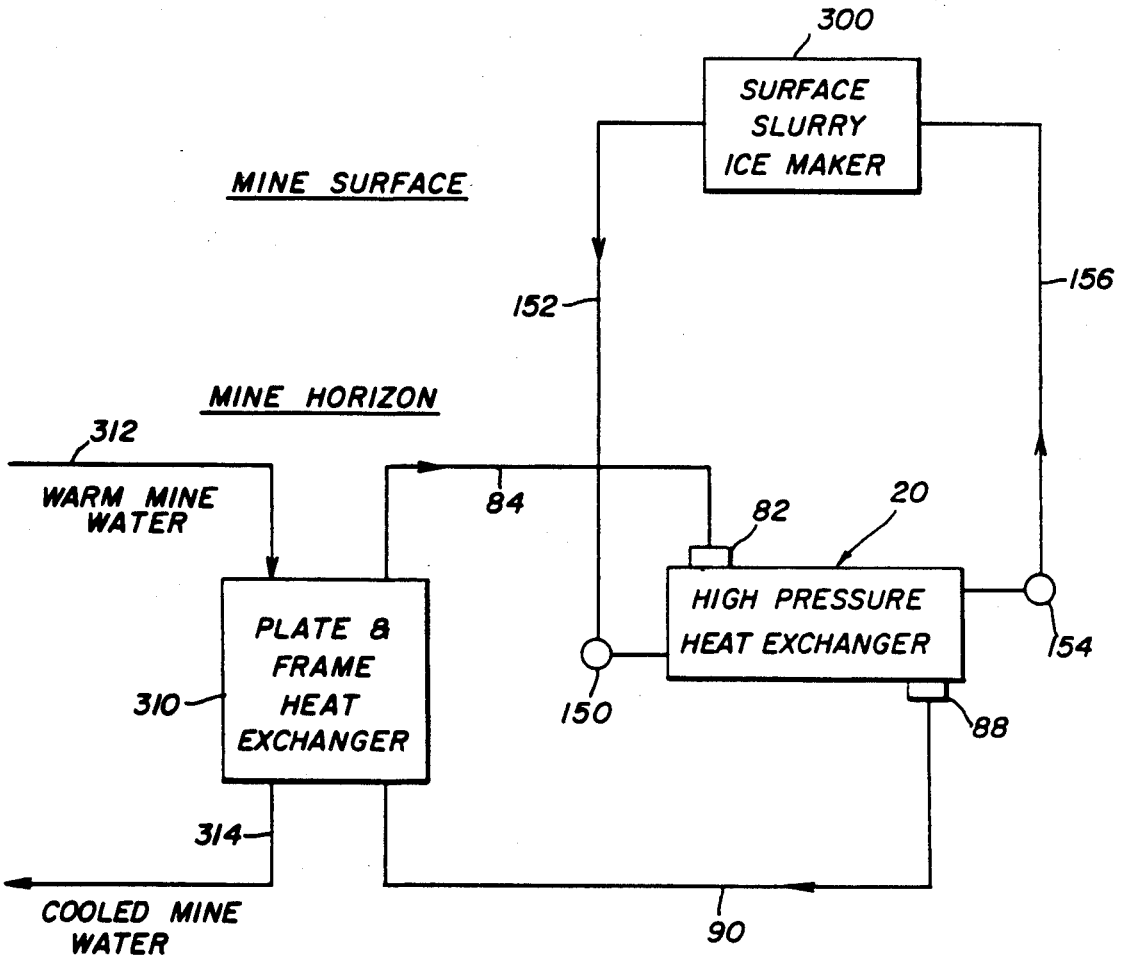
FIG. 8 is a schematic drawing illustrating how the high pressure heat exchanger can be used in a refrigeration apparatus or system.

FIG. 8 illustrates schematically a system for using the high pressure heat exchanger described above. A slurry ice maker 300 is positioned on the earth surface adjoining a deep mine shaft. The slurry ice is fed from the ice maker to conduit 152 which feeds it to high pressure inlet header 150 of high pressure heat exchanger 20 described above. The ice slurry flows through the tubular runs 200 in the heat exchanger and exits into high pressure outlet header 154 as warm water. Conduit 156 delivers the warm water from header 154 to ice maker 300. The described apparatus operates as a closed loop on the heat exchanger tube side so that energy required to pump the liquid is minimized.

An intermediate fluid is fed by conduit or pipe 84 to inlet header 82. As the warm intermediate fluid flows through the shell side of the heat exchanger 20, countercurrent to flow of ice slurry on the tube side, the intermediate fluid is cooled. The cooled intermediate fluid is removed by outlet header 88 and fed by conduit 90 to a low fouling plate and frame exchanger 310, or other cooling or refrigeration heat exchanger. High mineral content mine water can be fed by conduit 312 to the plate and frame heat exchanger 310. The plate and frame exchanger is designed for low pressure, is made from material which resists corrosion and is easily disassembled for cleaning. The cooled mine water is removed from heat exchanger 310 through conduit 314.

The foregoing detailed description has been given for clearness of understanding only, and no unnecessary limitations should be understood therefrom, as modifications will be obvious to those skilled in the art.

What is claimed is:

1. A high pressure heat exchanger including:

a body comprising a pair of spaced apart external parallel flat plates having substantially the same size and shape and with each plate terminating in a peripheral edge portion;

the body having side wall means joined to the peripheral edge portion of each external plate thereby enclosing a heat exchange space defined by the external plates;

the body having a plurality of spaced apart internal parallel flat baffle plates parallel to the external plates and with the peripheral edge portion of each baffle plate joined to the body side wall means by welding;

a tubular high pressure liquid inlet header external of the body;

means to feed high pressure liquid to the inlet header;

a tubular high pressure liquid outlet header external of the body;

means to withdraw high pressure liquid from the outlet header;

a plurality of separate tubular runs in communication with the inlet and outlet headers;

each tubular run including a tubular portion between substantially all adjacent plates of the body;

the tubular portions of the same run being interconnected at one end by a tubular liquid return means with a tubular portion on the opposite side of a first adjacent body plate and interconnected at the other end by a tubular liquid return means with any tubular portion that is on the opposite side of a second adjacent body plate;

the body interior having liquid communication means which permits a second liquid to flow from the space on one side of a baffle plate to the space on the other side of the baffle plate in a serpentine flow path through the body while in heat exchange contact with a first liquid flowing countercurrent in the tubular runs;

the body having inlet means for feeding a second liquid into the body so that it flows countercurrent to the first liquid in the tubes; and the body having outlet means for withdrawing the second liquid from the body.

2. A high pressure heat exchanger according to claim 1 in which, for most of the tubular runs, the tubular liquid return means at each end of the same tubular portion are U-shaped elements set in essentially a vertical plane.

3. A high pressure heat exchanger according to claim 1 in which, for most of the tubular runs, the tubular liquid return means at each end of the same tubular portion are U-shaped tubular elements set at essentially equal but opposite angles in a zig-zag pattern so that every other one of the tubular portions of a specific tubular run are on opposite sides of a plane normal to the body external plates.

4. A high pressure heat exchanger according to claim 1 in which the spaced apart parallel plates are rectangular and the tubular runs are substantially parallel to the longer side edges of the rectangular plates.

5. A high pressure heat exchanger according to claim 4 in which the high pressure liquid outlet header is substantially adjacent to the short side edges of the rectangular plates at one end of the heat exchanger.

6. A high pressure heat exchanger according to claim 4 in which the high pressure liquid inlet header is substantially adjacent to the short side edges of the rectangular plates at one end of the heat exchanger.

7. A high pressure heat exchanger according to claim 4 in which the high pressure liquid outlet and inlet headers are on the same ends of the heat exchanger.

8. A high pressure heat exchanger according to claim 4 in which the high pressure liquid outlet and inlet headers are on opposite ends of the heat exchanger.

9. A high pressure heat exchanger according to claim 2 in which each of the internal spaced apart parallel baffle plates has a slot adjacent one end and the tubular liquid return means are located in the slots, with the slots being at alternating ends of adjacent baffle plates.

10. A high pressure heat exchanger according to claim 2 in which the side wall means comprises spacer bars between the edges of adjacent plates and the plate edges are welded to the spacer bars and the adjoining spacer bar edges are welded together.

11. A high pressure heat exchanger according to claim 1 in which the external parallel plates are reinforced externally by stiffener means.

12. A high pressure heat exchanger including:

a body comprising a plurality of spaced apart parallel plates all having substantially the same size and shape and with each plate terminating in a peripheral edge portion;

the body having side wall means joined to the peripheral edge portion of each plate by welding thereby enclosing a space defined by the plurality of plates;

a tubular high pressure liquid inlet header external of the body;

means to feed high pressure liquid to the inlet header;

a tubular high pressure liquid outlet header external of the body;

means to withdraw high pressure liquid from the outlet header;

a plurality of separate tubular runs in communication with the inlet and outlet headers;

each tubular run including a tubular portion between substantially all adjacent plates of the body;

the tubular portions of the same run being interconnected at one end by a tubular liquid return means with a tubular portion on the opposite side of a first adjacent body plate and interconnected at the other end by a tubular liquid return means with any tubular portion that is on the opposite side of a second adjacent body plate;

the body internal plates having liquid communication means which permits a second liquid to flow from the space on one side of a baffle plate to the space on the other side of the baffle plate in a serpentine flow path through the body while in heat exchanger contact with a first liquid flowing countercurrent in the tubular runs;

the body having inlet means for feeding a second liquid into the body so that it flow countercurrent to the first liquid in the tubes; and the body having outlet means for withdrawing the second liquid from the body.

13. A high pressure heat exchanger according to claim 12 in which, for most of the tubular runs, the tubular liquid return means at each end of the same tubular portion are U-shaped tubular elements set at equal but opposite angles in a zig-zag pattern so that every other one of the tubular portions of a specific tubular run are on opposite sides of a plane normal to the body plates.

14. A high pressure heat exchanger according to claim 13 in which the spaced apart parallel plates are rectangular and the tubular runs are substantially parallel to the longer side edges of the rectangular plates.

15. A high pressure heat exchanger according to claim 14 in which at least one of the high pressure liquid outlet header and the high pressure liquid inlet header is substantially adjacent to the short side edges of the rectangular plates at one end of the heat exchanger.

16. A high pressure heat exchanger according to claim 15 in which the high pressure liquid outlet and inlet headers are on the same end of the heat exchanger.

17. A high pressure heat exchanger according to claim 14 in which each of the internal spaced apart parallel plates has a slot adjacent one end and the tubular liquid return means are located in the slots, with the slots being at alternating ends of adjacent plates.

18. A high pressure heat exchanger according to claim 14 in which the side wall means comprises spacer bars between the edges of adjacent plates and the plate edges are welded to the spacer bars and the adjoining spacer bar edges are welded together.

19. A high pressure heat exchanger according to claim 12 in which the external parallel platers are reinforced externally by stiffener means.

20. Refrigeration apparatus comprising:

a high pressure heat exchanger including a body comprising a pair of spaced apart external parallel flat plates having substantially the same size and shape and with each plate terminating in a peripheral edge portion; the body having side wall means joined to the peripheral edge portion of each external plate thereby enclosing a heat exchange space defined by the external plates; the body having a plurality of spaced apart internal parallel flat baffle plates parallel to the external plates and joined to the body side wall means; a high pressure aqueous liquid inlet header external of the body; a high pressure aqueous liquid outlet header external of the body; a plurality of separate tubular runs in communication with the inlet and outlet headers; each tubular run including a tubular portion between substantially all adjacent plates of the body; the tubular portions of the same run being interconnected at one end by a tubular liquid return means with a tubular portion on the opposite side of a first adjacent body plate and interconnected at the other end by a tubular liquid return means with any tubular portion that is on the opposite side of a second adjacent body plate; the body interior having liquid communication means which permits a second liquid to flow from the space on one side of a baffle plate to the space on the other side of the baffle plate in a serpentine flow path through the body while in heat exchange contact with a first liquid flowing countercurrent in the tubular runs; the body having inlet means for feeding a second liquid into the body so that it flows countercurrent to the first liquid in the tubes; and the body having outlet means for withdrawing the second liquid from the body;

a closed loop including cooling means to cool an aqueous liquid, conduit means for feeding the cooled aqueous liquid from the cooling means to the high pressure aqueous liquid inlet header and through the tube side of the high pressure heat exchanger, means for withdrawing warm cooling liquid from the high pressure aqueous liquid outlet header of the heat exchanger and returning it to the cooling means to be cooled again; and conduit means for feeding a warm fluid to the heat exchanger body inlet means and through the plate side of the heat exchanger to produce cooled fluid, conduit means for withdrawing the cooled fluid from the heat exchanger body outlet means and delivering it to a destination to be used for refrigeration purposes whereby it is converted to warm fluid, and conduit means for returning the warm fluid to the heat exchanger body inlet means so that it can flow through the plate side of the heat exchanger.

21. Refrigeration apparatus according to claim 20 in which the cooling means is at the earth surface of an under ground mine and the heat exchanger is at a mine horizon.

22. Refrigeration apparatus according to claim 20 in which the cooling means converts at least a portion of the aqueous liquid to ice to produce an ice slurry.

23. Refrigeration apparatus according to claim 20 in which the aqueous liquid is water, a salt brine or an aqueous glycol solution.

24. Refrigeration apparatus according to claim 20 in which the apparatus is arranged for flow of the warm fluid in the heat exchanger countercurrent to the flow of the cooling fluid in the tubular runs in the heat exchanger.

25. A high pressure heat exchanger including:

a body comprising a pair of spaced apart external parallel flat plates having substantially the same size and shape and with each plate terminating in a peripheral edge portion;

the body having side wall means joined to the peripheral edge portion of each external plate thereby enclosing a heat exchange space defined by the external plates;

the body having a plurality of spaced apart internal parallel flat baffle plates parallel to the external plates and joined to the body side wall means;

a high pressure liquid inlet header external of the body;

means to feed high pressure liquid to the inlet header;

a high pressure liquid outlet header external of the body;

means to withdraw high pressure liquid from the outlet header;

a plurality of separate tubular runs in communication with the inlet and outlet headers;

each tubular run including a tubular portion between substantially all adjacent plates of the body;

the external diameter of the tubular portions between the plates being less than the distance between adjacent parallel plates and with cross bars positioned lateral to the tubular portions between and in contact with the tubular portions and the adjacent parallel plate;

the tubular portions of the same run being interconnected at one end by a tubular liquid return means with a tubular portion on the opposite side of a first adjacent body plate and interconnected at the other end by a tubular liquid return means with any tubular portion that is one the opposite side of a second adjacent body plate;

the body interior having liquid communication means which permits a second liquid to flow from the space on one side of a baffle plate to the space on the other side of the baffle plate in a serpentine flow path through the body while in heat exchange contact with a first liquid flowing countercurrent in the tubular runs;

the body having inlet means for feeding a second liquid into the body so that it flow countercurrent to the first liquid in the tubes; and the body having outlet means for withdrawing the second liquid from the body.

26. A high pressure heat exchange including:

a body comprising a pair of spaced apart external parallel flat plates having substantially the same size and shape and with each plate terminating in a peripheral edge portion;

the body having side wall means joined to the peripheral edge portion of each external plate thereby enclosing a heat exchange space defined by the external plates;

the body having a plurality of spaced apart internal parallel flat baffle plates parallel to the external plates and joined to the body side wall means;

at least one side of each internal plate being covered with a layer of thermal insulation;

a high pressure liquid inlet header external of the body;

means to feed high pressure liquid to the inlet header;

a high pressure liquid outlet header external of the body;

means to withdraw high pressure liquid from the outlet header;

a plurality of separate tubular runs in communication with the inlet and outlet headers;

each tubular run including a tubular portion between substantially all adjacent plates of the body;

the tubular portions of the same run being interconnected at one end by a tubular liquid return means with a tubular portion on the opposite side of a first adjacent body plate and interconnected at the other end by a tubular liquid return means with any tubular portion that is on the opposite side of a second adjacent body plate;

the body interior having liquid communication means which permits a second liquid to flow from the space on one side of a baffle plate to the space on the other side of the baffle plate in a serpentine flow path through the body while in heat exchange contact with a first liquid flowing countercurrent in the tubular runs;

the body having inlet means for feeding as second liquid into the body so that it flow countercurrent to the first liquid in the tubes; and the body having outlet means for withdrawing the second liquid from the body.

27. A high pressure heat exchanger including:

a body comprising a plurality of spaced apart parallel plates all having substantially the same size and shape and with each plate terminating in a peripheral edge portion;

the body having side wall means joined to the peripheral edge portion of each plate thereby enclosing a space defined by the plurality plates;

a high pressure liquid inlet header external of the body;

means to feed high pressure liquid to the inlet header;

a high pressure liquid outlet header external of the body;

means to withdraw high pressure liquid from the outlet header;

a plurality of separate tubular runs in communication with the inlet and outlet headers;

each tubular run including a tubular portion between substantially all adjacent plates of the body;

the tubular portions of the same run being interconnected at one end by a tubular liquid return means with a tubular portion on the opposite side of a first adjacent body plate and interconnected at the other end by a tubular liquid return means with any tubular portion that is one the opposite side of a second adjacent body plate;

the external diameter of the tubular portions between the plates being less than the distance between adjacent parallel plates and with cross bars positioned lateral to the tubular portions between and in contact with the tubular portions and the adjacent parallel plate;

the body internal plates having a liquid communication means which permits a second liquid to flow from the space on one side of a baffle plate to the space on the other side of the baffle plate in a serpentine flow path through the body while in heat exchange contact with a first liquid flowing countercurrent in the tubular runs;

the body having inlet means for feeding a second liquid into the body so that it flows countercurrent to the first liquid in the tubes; and the body having outlet means for withdrawing the second liquid from the body.

28. A high pressure heat exchanger including:

a body comprising a plurality of spaced apart parallel plates all having substantially the same size and shape and with each plate terminating in a peripheral edge portion;

the body having side wall means joined to the peripheral edge portion of each plate thereby enclosing a space defined by the plurality plates;

a high pressure liquid inlet header external of the body;

at least one side of each internal plate being covered with a layer of thermal insulation;

means to feed high pressure liquid to the inlet header;

a high pressure liquid outlet header external of the body;

means to withdraw high pressure liquid from the outlet header;

a plurality of separate tubular runs in communication with the inlet and outlet headers;

each tubular run including a tubular portion between substantially all adjacent plates of the body;

the tubular portions of the same run being interconnected at one end by a tubular liquid return means with a tubular portion on the opposite side of a first adjacent body plate and interconnected at the other end by a tubular liquid return means with any tubular portion that is on the opposite side of a second adjacent body plate;

the body internal plates having liquid communication means which permits a second liquid to flow from the space on one side of a baffle plate to the space on the other side of the baffle plate in a serpentine flow path through the body while in heat exchange contact with a first liquid flowing countercurrent in the tubular runs;

the body having inlet means for feeding a second liquid into the body so that it flow countercurrent to the first liquid in the tubes; and the body having outlet means for withdrawing the second liquid from the body.

* * * * *

UNITED STATES PATENT AND TRADEMARK OFFICE

CERTIFICATE OF CORRECTION

PATENT NO. : 5,001,906

DATED : March 26, 1991

INVENTOR(S) : GERALD E. ENGDAHL ET AL

It is certified that error appears in the above-identified patent and that said Letters Patent is hereby corrected as shown below:

Column 2, second line from the bottom, change "walls" to -- wall --; column 9, lines 44-45, change "exchanger" to -- exchange --; column 10, line 15, change "platers" to -- plates --; column 11, line 54, change "one" to -- on --; column 12, line 40, change "as" to -- a --; line 41, change "flow" to -- flows --, line 52, after "plurality" insert -- of --; column 13, line 1, change "one" to -- on --, line 29, after "plurality" insert -- of --; column 14, line 27, change "flow" to -- flows --.

Signed and Sealed this

Eleventh Day of August, 1992

*Attest:*

DOUGLAS B. COMER

*Attesting Officer*

*Acting Commissioner of Patents and Trademarks*